US011350706B2

(12) United States Patent
Park

(10) Patent No.: US 11,350,706 B2
(45) Date of Patent: Jun. 7, 2022

(54) SECUREMENT FOR ZIPPERED LUGGAGE

(71) Applicant: RMD Luggage Concepts Pty Ltd, Wonthaggi (AU)

(72) Inventor: Ross Park, Wonthaggi (AU)

(73) Assignee: RMD Luggage Concepts Pty Ltd, Wonthaggi (AU)

( * ) Notice: Subject to any disclaimer, the term of this patent is extended or adjusted under 35 U.S.C. 154(b) by 749 days.

(21) Appl. No.: 16/305,271

(22) PCT Filed: May 31, 2017

(86) PCT No.: PCT/AU2017/050522

§ 371 (c)(1),
(2) Date: Nov. 28, 2018

(87) PCT Pub. No.: WO2017/210722

PCT Pub. Date: Dec. 14, 2017

(65) Prior Publication Data

US 2020/0329828 A1 Oct. 22, 2020

(30) Foreign Application Priority Data

Jun. 9, 2016 (AU) ..... 2016902251

(51) Int. Cl.

| | |
|---|---|
| ***A44B 19/30*** | (2006.01) |
| ***A45C 13/10*** | (2006.01) |
| ***A45C 13/42*** | (2006.01) |
| ***A45C 13/18*** | (2006.01) |

(52) U.S. Cl.

CPC ..... *A44B 19/30* (2013.01); *A45C 13/103* (2013.01); *A45C 13/18* (2013.01); *A45C 13/42* (2013.01)

(58) Field of Classification Search

CPC ..... A44B 19/30; A45C 13/103; A45C 13/18; A45C 13/42

See application file for complete search history.

(56) References Cited

U.S. PATENT DOCUMENTS 3,319,743 A * 5/1967 Pelavin ..... A44B 19/301 190/120
4,685,315 A * 8/1987 Comolli ..... A44B 11/005 190/120

(Continued)

FOREIGN PATENT DOCUMENTS

CN 202417052 U 9/2012
GB 2 381 830 A 5/2003

OTHER PUBLICATIONS

International Search Report of PCT/AU2017/050522, dated Jul. 21, 2017.

*Primary Examiner* — David M Upchurch
(74) *Attorney, Agent, or Firm* — Collard & Roe, P.C.

(57) ABSTRACT

A securement for zippered luggage, including a housing to substantially cover a pair of sliders of a zipper of the luggage and to prevent movement of the sliders along a tape of the zipper, the housing being formed of a first part which receives the sliders and a second part which engages the first part to substantially encapsulate and prevent movement of the sliders, wherein the first and second parts are secured together in the inoperative securing condition by an element which requires breaking or permanent deformation to permit displacement of the second part to allow movement of the sliders.

7 Claims, 5 Drawing Sheets

(56) References Cited

U.S. PATENT DOCUMENTS

| | | | | |
|---|---|---|---|---|
| 5,031,944 | A * | 7/1991 | Keyaki | A44B 19/301 292/307 R |
| 6,308,541 | B1 * | 10/2001 | Stowe | A44B 19/301 70/312 |
| 7,464,569 | B2 | 12/2008 | Kolton et al. | |
| 7,516,523 | B2 * | 4/2009 | Okot | A44B 19/262 24/382 |
| 8,196,442 | B1 | 6/2012 | Lassen et al. | |
| 8,558,700 | B2 | 10/2013 | Chen | |
| 9,194,158 | B2 * | 11/2015 | Lai | A45C 5/00 |
| 2003/0066170 | A1 * | 4/2003 | Huang | A44B 19/301 24/387 |
| 2004/0237605 | A1 * | 12/2004 | Lin | A44B 19/301 70/68 |
| 2018/0279735 | A1 * | 10/2018 | Paul | A45C 5/03 |
| 2020/0022468 | A1 * | 1/2020 | Song | E05B 65/52 |

* cited by examiner

SECUREMENT FOR ZIPPERED LUGGAGE

CROSS REFERENCE TO RELATED APPLICATIONS

This application is the National Stage of PCT/AU2017/050522 filed on May 31, 2017, which claims priority under 35 U.S.C. § 119 of Australian Application No. 2016902251 filed on Jun. 9, 2016, the disclosures of which are incorporated by reference. The international application under PCT article 21(2) was published in English.

FIELD OF THE INVENTION

The present invention relates to a securement for zippered luggage.

BACKGROUND OF THE INVENTION

Personal luggage, particularly zippered luggage, is vulnerable to tampering during travelling and while out-of-sight of a user. Tampering of luggage may happen during many forms of travelling, or while left unattended at a location such as a hotel, though it is a common problem during transportation connected with air travel and may arise due to theft of personal belongings or smuggling of restricted goods for example.

Zippers provide a particular point of vulnerability as the zipper can be separated using a sharp object, providing direct and unrestricted access to the luggage. Once luggage has been pilfered or restricted goods added, moving the sliders of the zipper over the opening can reclose the opening so that there is no indication that the luggage has been tampered with. This vulnerability renders padlocks, plastic wrapping, straps and cable or zip ties of 20 little use against tampering.

Examples of the invention seek to solve, or at least ameliorate, one or more disadvantages of previous securements for zippered luggage.

SUMMARY OF THE INVENTION

According to the present invention, there is provided a securement for zippered luggage, including a housing to substantially cover a pair of sliders of a zipper of the luggage and to prevent movement of the sliders along a tape of the zipper, the housing being formed of a first part which receives the sliders and a second part which engages the first part to substantially encapsulate and prevent movement of the sliders, wherein the first and second parts are secured together in their operative securing condition by an element which requires breaking or permanent deformation to permit displacement of the second part to allow movement of the sliders.

According to a preferred embodiment, the first part is formed with an aperture for receiving an extension of the second part, the aperture and the extension being arranged generally perpendicular to the zipper to secure the sliders in a closed position. Preferably, the extension and aperture are arranged to be parallel to a longitudinal axis of the element so that separation of the first and second parts and movement of the sliders cannot be achieved without breaking or permanently deforming the element.

Preferably, the housing is formed with locking teeth for engaging the tape to prevent movement of the sliders. Preferably, the first part has a landing portion upon which each zipper is received, the landing portion being curved so that bringing the first and second parts into engagement urges the locking teeth against the tape.

The element can include a planar portion to be received against either the first part or the second part, and an elongate extension configured to extend through an aperture formed in either the first part or the second part, the elongate extension being securable in the other part. Preferably, the elongate extension is formed with teeth that engage a pawl formed within the other part for securement of the elongate extension.

The securement can further include a RFID tag for location and identification of the luggage, the RFID tag being fixed to either of the first and second parts. The securement can further include a QR code printed on either the first or second parts for identifying the luggage.

BRIEF DESCRIPTION OF THE DRAWINGS

Preferred embodiments of the invention will be further described, by way of non-limiting example only, with reference to the accompanying drawings in which.

DETAILED DESCRIPTION

Figure 1:
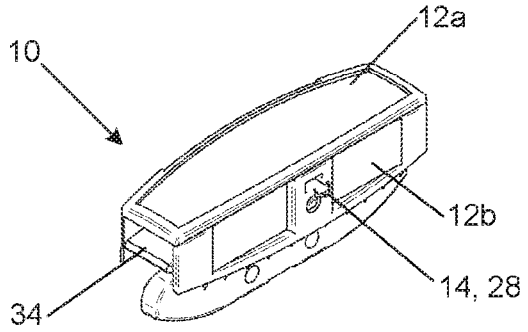
FIG. 1 is an upper perspective view of a securement for zippered luggage of one embodiment of the invention.
Figure 2:
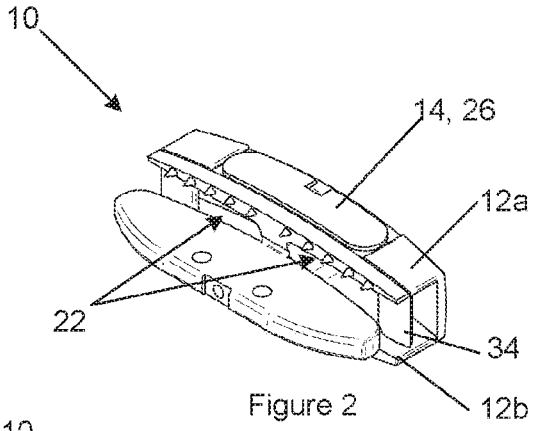
FIG. 2 is a lower side perspective view of the securement.
Figure 3:
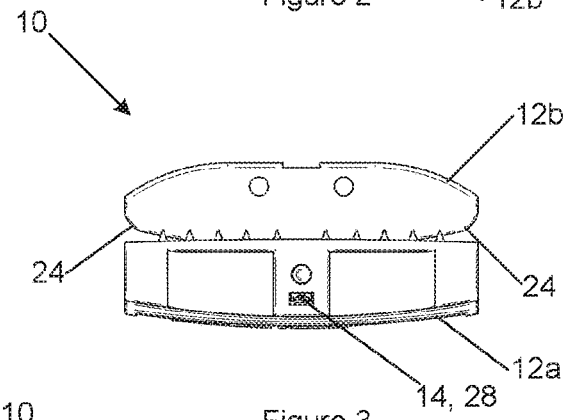
FIG. 3 is a side elevation of the securement.
Figure 4:
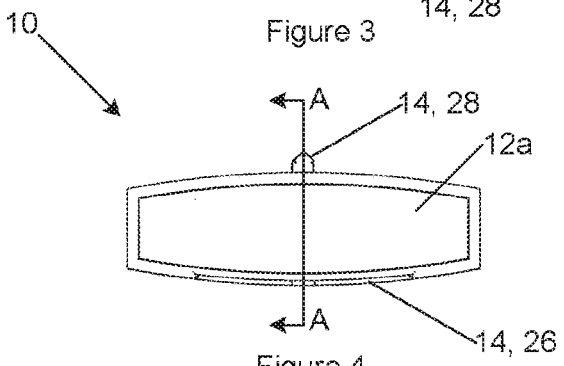
FIG. 4 is a plan view of the securement.
Figure 5:
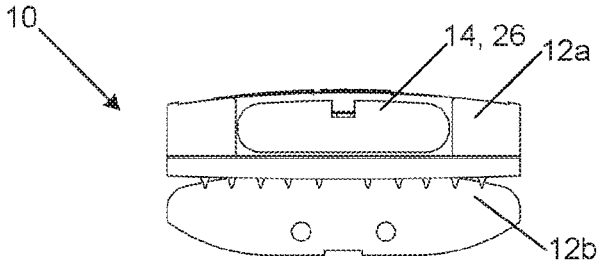
FIG. 5 is another side elevation of the securement.

With reference to FIG. 1, there is shown a securement 10 according to a preferred embodiment of the present invention. The securement 10 is configured for use with zippered luggage. The securement 10 provides a tamper evident seal for zippered luggage, not for the purposes of preventing access to zippered luggage, but so that a user can identify if their luggage has been tampered with, thereby allowing a user to refuse to collect the luggage until further inspection has been made.

The securement 10 includes a housing formed of a first part 12*a* (see FIGS. 9 to 13) and a second part 12*b* (see FIGS. 14 to 18). The first and second parts 12*a*, 12*b* act to substantially cover a pair of sliders (not shown) of a zipper of the luggage and to prevent movement of the sliders along a tape of the zipper. The first part 12*a* receives the sliders and the second part 12*b* engages the first part 12*a* to substantially encapsulate and prevent movement of the sliders. The first and second parts 12*a*, 12*b* are secured together in their operative securing condition by a securing element 14 (see FIGS. 18 to 22) which requires breaking or permanent deformation to permit displacement of the second part 12*b* and release the sliders from the first part 12*a* to allow movement of the sliders.

In the illustrated embodiment, the first and second parts 12*a*, 12*b* are shown as separate, discrete elements, though it will be appreciated that other configurations are also possible.

For example, the housing may be integrally formed or formed as a single unit having first and second parts movable with respect to each other, using a hinge for example, to form a securement for encapsulating the sliders.

FIGS. 9 to 13 illustrate in more detail the first part 12*a* of the housing. The first part 12*a* is formed with an aperture 16 for receiving an extension 18 of the second part 12*b*. The first part 12*a* is also formed with an aperture 20 for receiving the securing element 14. In use, securing element 14 is inserted through aperture 17 formed in the second part 12*b* (see FIG. 14) and secured to the first part 12*a* within aperture 20, as will be described further below. The aperture 16 and the extension 18 are arranged generally perpendicular to the zipper to secure the sliders in a closed position and prevent movement of the sliders along the zipper. Securing the first and second parts 12*a*, 12*b* in this manner effectively clamps the securement along an axis generally perpendicular to the zipper, thereby providing that separation is a different action to movement of the zippers. The extension 18 and aperture 16 are also arranged to be perpendicular to a longitudinal axis of the element 14 so that separation of the first and second parts 12*a*, 12*b* and movement of the sliders cannot be achieved without breaking or permanently deforming the element 14.

The housing is formed with locking teeth 22 on the first part 12*a* for engaging the tape to prevent movement of the sliders. To assist with engagement of the tape by the housing, the first part 12*a* has a landing portion 24 upon which each zipper is received. The landing portion 24 is curved so as to urge the sliders away from the tape, thereby bringing the housing into firmer contact with the tape, so that bringing the first and second parts 12*a*, 30 12*b* into engagement urges the locking teeth 22 against the tape. Although described as being curved, landing portion 24 may also be a generally straight and inclined surface. By securing the sliders against movement along the tape, tampering of the luggage by opening the zipper cannot be hidden from a user by simply moving the sliders over the opening to reclose it. Accordingly, a user will be able to determine if their luggage has been tampered with and whether they should accept it after travel or upon discovery, be it in a hotel room or storage for example.

FIGS. 14 to 18 illustrate in more detail the second part 12*b* of the housing. The second part 12*b* is formed with an extension 18 in the form of a circular element extending from the second part 12*b* for receipt in aperture 16 of the first part 12*a*. Extension 18 guides the second part 12*b* as it is brought into contact with the first part 12*a*, ensuring that relative movement between the first and second parts 12*a*, 12*b* can only be perpendicular to the zipper.

The second part 12*b* also has extensions 34 extending from the second part 12*b* to the first part 12*a*. The extensions 34 are configured to extend behind the slider once received by the first part 12*a* to prevent removal from the sliders once the first and second parts 12*a*, 12*b* have been brought into engagement.

FIGS. 19 to 22 illustrate in more detail the securing element 14. The securing element 14 includes a planar portion 26 to be received against the second part 12*b*, though in alternative embodiments the planar portion 26 may be received against the first part 12*a*.

The securing element 14 also includes an elongate extension 28 configured to extend through aperture 17 of the second part 12*b* and into aperture 20 of the first part 12*a*, though it will be appreciated that alternative configuration will exist where the elongate extension 28 extends into either the first part 12*a* or the second part 12*b*, with the elongate extension 28 being securable in the other part.

Figure 6:
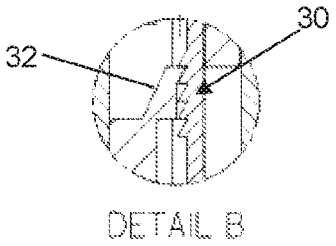
FIG. 6 is a close sectional view of Detail B indicated in FIG. 7.
Figure 7:
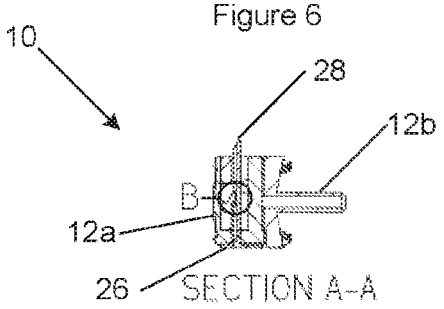
FIG. 7 is an end view of a section taken along line A-A of FIG. 4.
Figure 8:
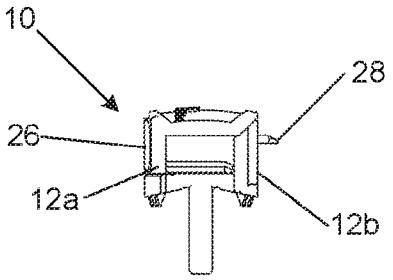
FIG. 8 is an end view of the securement.
Figure 9:
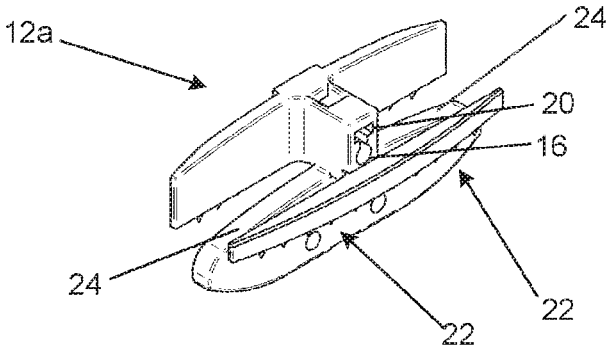
FIGS. 9 to 13 are respective upper perspective, lower perspective, side, underneath and end views of a first part of the securement.
Figure 10:
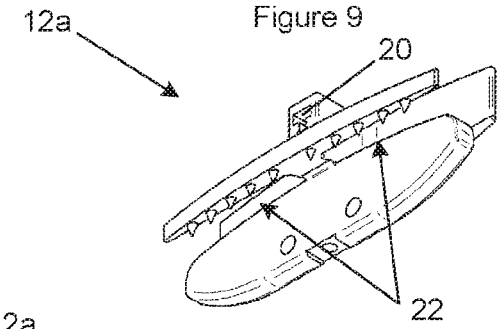
Figure 11:
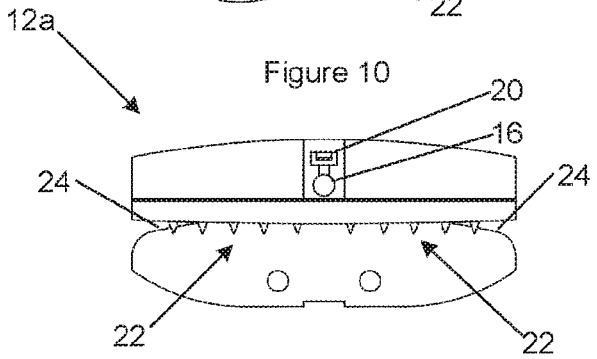
Figure 12:
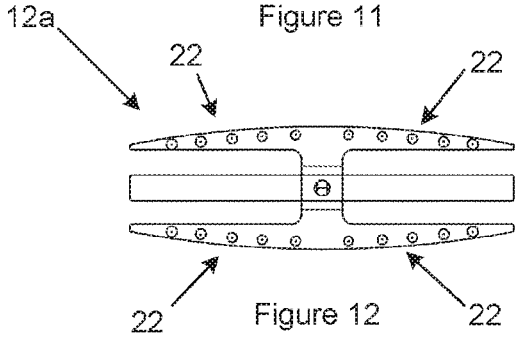
Figure 13:
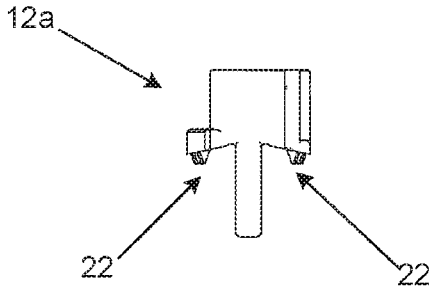
Figure 14:
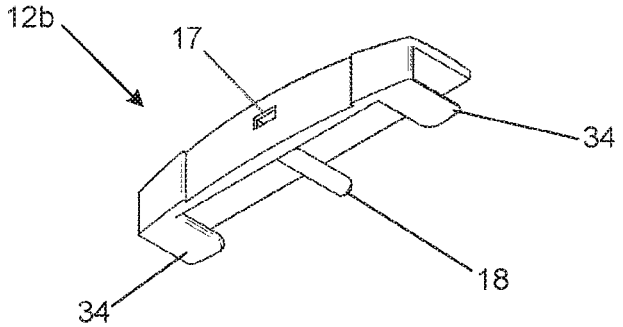
FIGS. 14 to 18 are respective lower perspective, upper perspective, side, end and underneath views of a second part of the securement.
Figure 15:
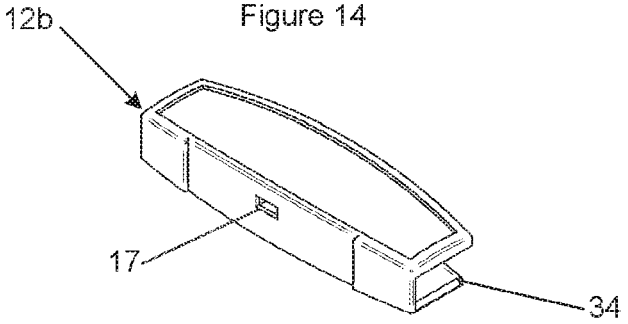
Figure 16:
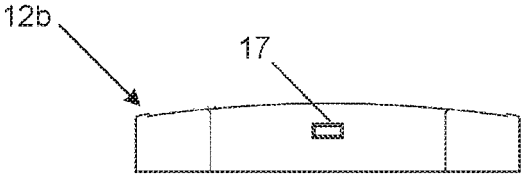
Figure 17:
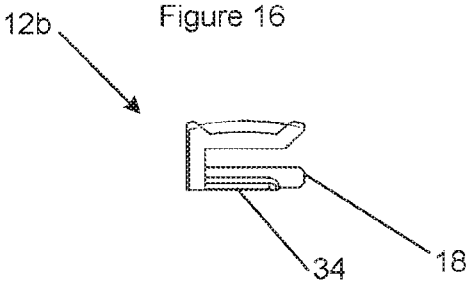
Figure 18:
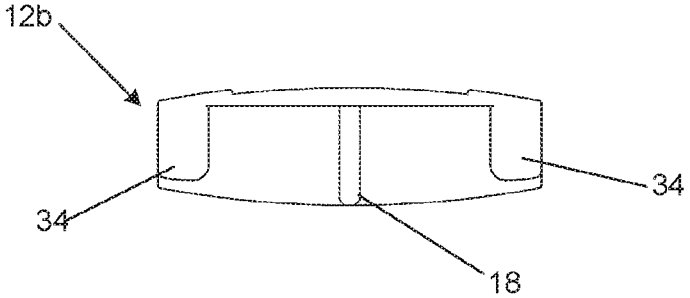
Figure 19:
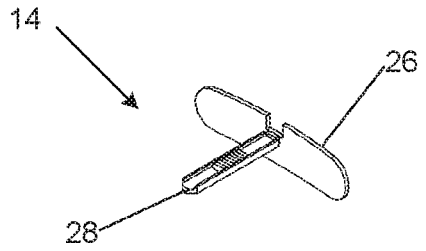
FIGS. 19 to 22 are respective perspective, plan, side and end views of a securing element.
Figure 20:
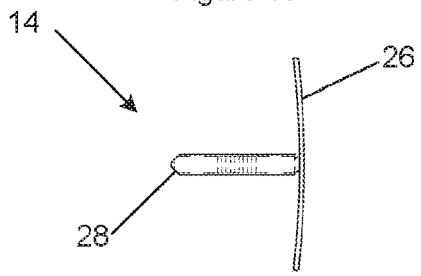
Figure 21:
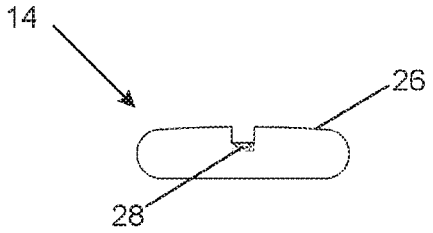
Figure 22:
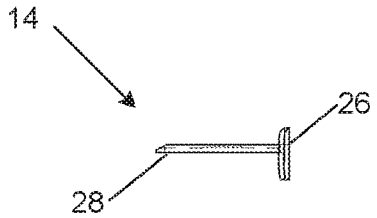

As can be seen in FIG. 6, the elongate extension 28 is formed with teeth 30 that engage a pawl 32 formed within the other part, which in the described embodiment is the first part 12*a*, for securement of the elongate extension 28. Accordingly, advancing the elongate extension 28 of the securing element 14 through the aperture 17 in the second part 12*b* and then into aperture 20 in the first part 12*a* brings the teeth 30 into engagement with pawl 32 to secure the first and second parts 12*a*, 12*b* together.

To assist with identification and tracking of luggage, the securement 10 may also further include a RFID tag (not shown) for location and identification of the luggage. The RFID tag may be fixed to either of the first and second parts 12*a*, 12*b*. The securement 10 may also include a QR code printed on either the first or second parts 12*a*, 12*b* for identifying the luggage.

In use, a user may order a kit containing a first and second part 12*a*, 12*b* and a plurality of securing elements 14. Either the first or second parts 12*a*, 12*b* may be personalised with the QR code and RFID tag, of the QR code and RFID tag may be printed on the securing elements 14, thereby preventing a foreign securing element 14 to be used to hide tampering of the user's luggage. The user will also have a unique identifier randomly selected number assigned to them and printed on the part 12*a* and securing elements 14. This allows a user to quickly identify their device and/or scan the QR code to determine that the luggage is theirs and that the securing element is also theirs.

The embodiments have been described by way of example only and modifications are 20 possible within the scope of the invention disclosed.

REFERENCE NUMERAL LIST

10 Securement
12*a* First part of housing
12*b* Second part of housing
14 Securing element
16 Aperture
18 Extension
20 Aperture for securing element
22 Locking teeth
24 Landing
26 Planar portion
28 Elongate extension
30 Teeth
32 Pawl
34 Extension

The invention claimed is:

1. A securement for zippered luggage having a zipper with a pair of sliders and a tape, the securement comprising:

a housing to substantially cover the pair of sliders of the zipper of the luggage and to prevent movement of the sliders along the tape of the zipper, the housing comprising:

a first part which receives the sliders comprising a landing portion upon which each zipper is received, the landing portion being curved so that bringing the first and second parts into engagement urges the locking teeth against the tape;

locking teeth for engaging the tape to prevent movement of the sliders; and a second part which engages the first part to substantially encapsulate and prevent movement of the sliders, wherein the first and second parts are secured together in their operative securing condition by an element which requires breaking or permanent deformation to permit displacement of the second part to allow movement of the sliders.

2. The securement according to claim 1, wherein the first part is formed with an aperture for receiving an extension of the second part, the aperture and the extension being arranged generally perpendicular to the zipper to secure the sliders in a closed position.

3. The securement according to claim 2, wherein the extension and aperture are arranged to be parallel to a longitudinal axis of the element so that separation of the first and second parts and movement of the sliders cannot be achieved without breaking or permanently deforming the element.

4. The securement according to claim 1, wherein the element includes a planar portion to be received against either the first part or the second part, and an elongate extension configured to extend through an aperture formed in either the first part or the second part, the elongate extension being securable in either the first part or the second part.

5. The securement according to claim 4, wherein the elongate extension is formed with teeth that engage a pawl formed within either the first part or the second part for securement of the elongate extension.

6. The securement according to claim 1, further including a RFID tag for location and identification of the luggage, the RFID tag being fixed to either of the first and second parts.

7. The securement according to claim 1, further including a QR code printed on either the first or second parts for identifying the luggage.

* * * * *